US005913440A

United States Patent [19]

Bobko et al.

[11] Patent Number: 5,913,440

[45] Date of Patent: Jun. 22, 1999

[54] DRAIN SAVER

[76] Inventors: Susan Bobko; Robert Bobko, both of 28 Parrott Pl., Brooklyn, N.Y. 11228

[21] Appl. No.: 09/012,628

[22] Filed: Jan. 23, 1998

[51] Int. Cl.[6] ..... B65D 33/02

[52] U.S. Cl. ..... 220/9.4; 220/572; 220/9.3; 220/910

[58] Field of Search ..... 220/9.3, 9.2, 9.1, 220/572, 571, 9.4, 495.03, 495.04, 495.06, 495.08, 495.1, 666, 908.1, 910, DIG. 6

[56] References Cited

U.S. PATENT DOCUMENTS

| | | | |
|---|---|---|---|
| 192,851 | 7/1877 | Van Arnum | 220/9.3 |
| 2,451,829 | 10/1948 | Hightower . | |
| 2,502,323 | 3/1950 | Jackson | 220/9.3 |
| 2,543,243 | 2/1951 | Kliewer | 220/9.3 |
| 4,120,417 | 10/1978 | Aquino | 220/9.4 |
| 4,921,193 | 5/1990 | Benesch . | |
| 5,639,050 | 6/1997 | Peterson et al. . | |

FOREIGN PATENT DOCUMENTS

| | | | |
|---|---|---|---|
| 12874 | of 1888 | United Kingdom | 220/9.3 |

*Primary Examiner*—Stephen Castellano
*Attorney, Agent, or Firm*—Goldstein & Canino

[57] ABSTRACT

A drain saving device for use in a sink having a drain, comprising a framework, and a bag that is supported by the framework. The framework comprises a pair of side supports and a connecting bar that extends between the side supports. The side supports each have a pair of supporting members, each of which have a top end that has a downwardly curving hook. The connecting bar is telescoping for adjusting the distance between the side supports, so that the framework may fit in different sized sinks. The bag has an upper end which drapes over the downwardly curving hooks, and a lower end having a perforated lower surface. Food preparation activities, such as cleaning meat, poultry, and vegetables, may be carried out over the bag, wherein liquids are allowed to seep through the bag and reach the drain, while debris is maintained within the bag and is prevented from reaching the drain.

4 Claims, 2 Drawing Sheets

DRAIN SAVER

BACKGROUND OF THE INVENTION

The invention relates to a drain saver. More particularly, the invention relates to a device having a framework that fits within a sink and supports a bag having a perforated lower surface for holding or catching food preparation by-products, allowing water to seep through the bag and reach the drain in the sink, while preventing food and debris from reaching the drain.

While preparing foods before cooking, it is often desirable to work over the sink. However, common food preparation activities, such as cleaning meat and vegetables can create debris which will quickly clog the drain.

While cooking, people have the tendency to pile pots, pans, and utensils in the sink. Especially when in a hurry, they usually are not particularly careful about avoiding placing large food particles in the sink. Once in the sink, these food particles can quickly reach the drain, where they partially or completely block the flow of water into the drain. Worse still, food particles often make their way through the drain but get stuck in the pipes or the sink trap.

Similarly, when cleaning up after a meal, most people make a valiant attempt to scrape the largest food particles off their plate and into the garbage before putting the plate in the sink. Even this practice however, is not fool-proof. Large particles are often missed, and make their way toward the drain when the dishes are rinsed.

Perforated drain stainers provide a barrier against larger particles reaching the drain. These particles collect in the drain strainers, which is removable from the drain for cleaning. Thus the drain strainer simply makes clearing the clog easier, but does nothing to prevent the clog from actually occurring.

While these units may be suitable for the particular purpose employed, or for general use, they would not be as suitable for the purposes of the present invention as disclosed hereafter.

SUMMARY OF THE INVENTION

It is an object of the invention to produce a drain saving device which installs in a sink, and prevents debris from reaching the drain.

It is another object of the invention to produce a drain saving device which allows a person to clean vegetables, remove fat from meat and poultry, and rinse debris from plates over the drain saving device, which effectively catches any debris generated from these activities, and maintains them within the bag.

It is a further object of the invention to provide a device which is capable of stock piling and holding a large quantity of kitchen implements, while allowing water to drain away therefrom.

It is yet a further object of the invention to provide a device which provides a framework that supports a bag having a perforated lower surface. Pots, pans, and kitchen implements may be piled inside the bag, or food may be prepared over the bag, wherein water is allowed to drain through the perforated lower surface, whereas debris is held within the bag. The perforated lower surface provides a much larger surface area than a standard drain, thus the bag still allows a considerable quantity of water to pass therethrough, even when much debris has already collected on the lower surface of the bag.

The invention is a drain saving device for use in a sink having a drain, comprising a framework, and a bag that is supported by the framework. The framework comprises a pair of side supports and a connecting bar that extends between the side supports. The side supports each have a pair of supporting members, each of which have a top end that has a downwardly curving hook. The connecting bar is telescoping for adjusting the distance between the side supports, so that the framework may fit in different sized sinks. The bag has an upper end which drapes over the downwardly curving hooks, and a lower end having a perforated lower surface. Food preparation activities, such as cleaning meat, poultry, and vegetables, may be carried out over the bag, wherein liquids are allowed to seep through the bag and reach the drain, while debris is maintained within the bag and is prevented from reaching the drain.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
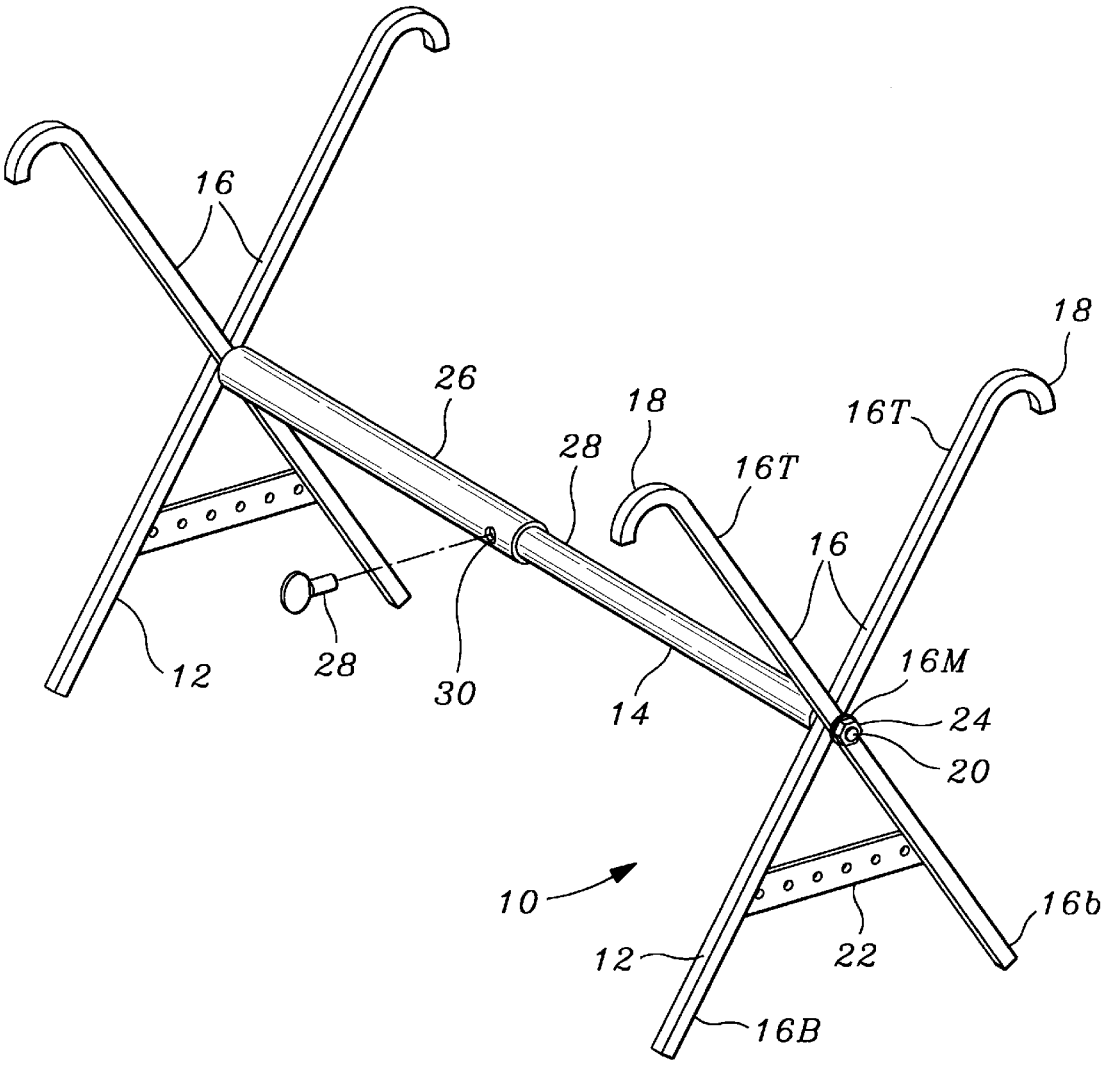
FIG. 1 is a diagrammatic perspective view of a framework according to the present invention.

The present invention is a drain saving device which fits within a sink, having a drain. FIG. 1 illustrates a framework 10 according to the present invention. The framework 10 comprises a pair of side supports 12 and a connecting bar 14.

The side supports 12 comprise a pair of support members 16, each having a base end 16B that rests in the sink around the drain, and a top end 16T. The top end 16T of each support member 16 has a downwardly curving hook 18. The support members 16 each have a midpoint 16M. The support members 16 for each side support 12 are connected together at the midpoint 16M with a main axis 20. A brace 22 extends between the support members 16 on each of the side supports 12 between the base end 16B and the midpoint 16M.

The connecting bar 14 spans a distance between the side supports 12, and is connected to each of the side supports 12 at the main axis 20 with a connecting bolt 24. The connecting bar 14 is telescoping, having an outer tube 26 and an inner tube 28 which slides within the outer tube 26 to adjust the distance between the side supports 12. A fixing pin 29 inserts through an outer tube bore 30 for fixing the relationship between the outer tube 26 and inner tube 28 and preventing adjustment of the distance between the side supports 12.

Figure 2:
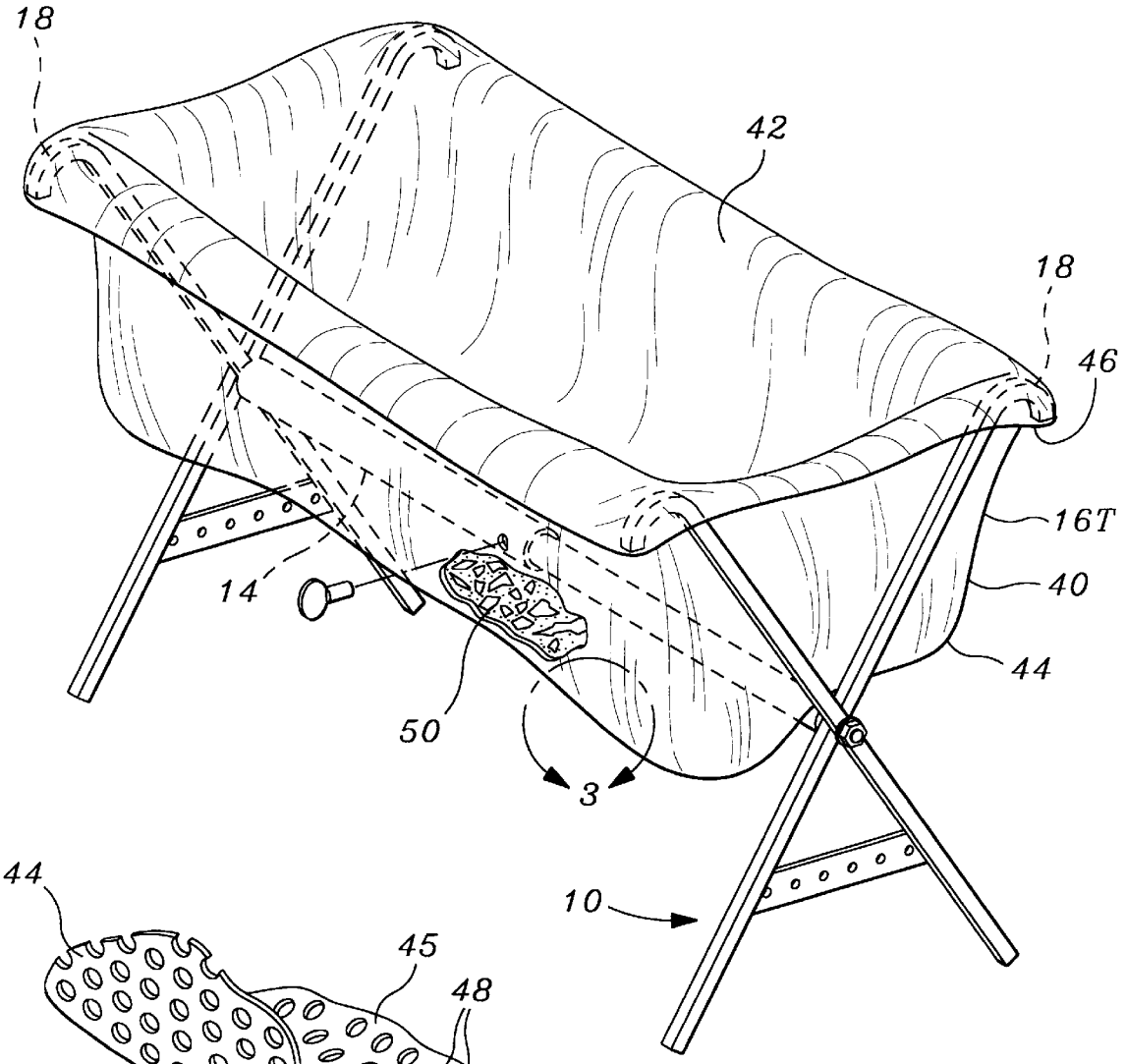
FIG. 2 is a is a diagrammatic perspective view of the invention, wherein a bag is supported in the framework.

Referring to FIG. 2, a bag 40 is supported within the framework 10 above the drain of the sink, wherein the bag 40 has an upper end 42 and a lower portion 44. The upper end 42 comprises an upper lip 46. Accordingly, the bag 40 is draped over the top end 16T of the support members 16 wherein the upper lip 46 extends over the downwardly curving hooks 18. The lower portion 44 of the bag drapes to one side of the connecting bar 14.

Figure 3:
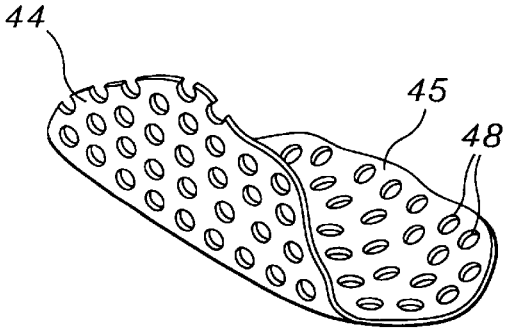
FIG. 3 is a portion of the bag, removed and enlarged from the area generally indicated by circle 3 in FIG. 1.

Debris 50 is piled within the bag 40, and may be piled as high as the upper end 42 without risk of spilling any contents outside the bag 40. Referring to FIG. 3, the lower portion 44 includes a perforated lower surface 45, having a plurality of perforations 48. The perforations 48 are large enough to allow water to seep through, but small enough to prevent solid food debris from traveling through. The bag 40 is draped to one side or the other of the connecting bar 14. Thus, drainable liquids are allowed to reach the perforated lower surface 45, wherein a large surface area allows the drainable liquids to seep through quickly.

Further, the bags 40 may be easily removed by simply pulling the entire bag 40 up and free of the downwardly curving hooks 18. A fresh bag 40 may then be restored onto the framework 10 by simply stretching the upper lip 46 over the downwardly curving hooks 18 and draping the bag 40 to one side of the connecting bar 14.

In conclusion, herein is presented a device which comprises a framework that is inserted within a sink and supports a bag having a perforated lower surface. The bag allows food preparation activities to be conducted over the bag wherein water is allowed to seep through the perforated lower portion to reach the drain of the sink, while food debris is retained within the bag.

What is claimed is:

1. A drain saving device, for use in a sink having a drain, comprising:

a framework for fitting within the sink having a pair of side supports and a connecting bar extending a distance between the side supports, the side supports each comprising a pair of supporting members, each supporting member having a base end that is capable of resting in the sink around the drain and a top end having a downwardly curving hook, each supporting member has a midpoint, the supporting members for each side support are connected together at the midpoint; the connecting bar is connected to each side support at its midpoint, the connecting bar being adjustable to adjust the distance between the side supports so that the drain saving device may be adapted to different sized sinks; and a bag, having a perforated lower surface, said bag is supported by the framework above the drain, allowing food preparation activities to be conducted over the bag wherein debris may fall into or be placed in the bag and wherein liquids are allowed to seep through the lower surface while the debris is maintained within the bag.

2. The drain saving device as recited in claim 1, wherein the bag comprises an upper end having an upper lip, and a lower portion having the lower perforated surface, the bag is draped over the top ends of the supporting members wherein the upper lip extends over the downwardly curving hooks.

3. The drain saving device as recited in claim 2, wherein the connecting bar further comprises an outer tube and an inner tube, the inner tube extending within the outer tube, and further comprising a fixing pin which fixes the inner tube to the outer tube to prevent adjustment of the distance between the side supports.

4. The drain saving device as recited in claim 3, wherein each of the side supports further comprises a brace which extends between the supporting members.

* * * * *